US006045158A

United States Patent [19]

Bergstresser

[11] Patent Number: 6,045,158

[45] Date of Patent: Apr. 4, 2000

[54] FOLDOUT INFORMATION BOOK AND METHOD FOR MAKING THE SAME

[76] Inventor: Patricia Bergstresser, Kramgasse 55, 3011 Bern, Switzerland

[21] Appl. No.: 09/346,581

[22] Filed: Jul. 2, 1999

[51] Int. Cl.[7] ..... B42D 19/00

[52] U.S. Cl. ..... 281/5; 283/34

[58] Field of Search ..... 281/2, 3.1, 5, 9, 281/10, 12, 15.1, 38; 283/34, 35; 434/150

[56] References Cited

U.S. PATENT DOCUMENTS

| | | | |
|---|---|---|---|
| 2,295,704 | 9/1942 | Wade et al. . | |
| 4,046,368 | 9/1977 | LeBreton . | |
| 4,210,347 | 7/1980 | Robbins et al. . | |
| 4,270,773 | 6/1981 | Gaetano . | |
| 4,289,333 | 9/1981 | Gaetano . | |
| 4,348,038 | 9/1982 | Lynch . | |
| 4,606,553 | 8/1986 | Nickerson . | |
| 4,801,157 | 1/1989 | Sink . | |
| 4,968,062 | 11/1990 | Bus | 283/34 X |
| 5,029,902 | 7/1991 | Komori . | |
| 5,046,710 | 9/1991 | Vijuk . | |
| 5,156,898 | 10/1992 | McDonald | 283/34 X |
| 5,222,764 | 6/1993 | Dyer . | |
| 5,234,231 | 8/1993 | Hollander et al. . | |
| 5,282,690 | 2/1994 | Moseley . | |
| 5,549,332 | 8/1996 | Judson . | |
| 5,725,252 | 3/1998 | Crum et al. | 283/34 |
| 5,794,980 | 8/1998 | Bigler . | |
| 5,868,429 | 2/1999 | Raymond et al. | 283/34 |

*Primary Examiner*—Willmon Fridie, Jr.
*Attorney, Agent, or Firm*—Evenson, McKeown, Edwards & Lenahan, P.L.L.C.

[57] ABSTRACT

A book assembly and method of making the same, made of at least one generally planar sheet having an upper side and a reverse side with writing thereon. The sheet is provided with a plurality of primary folds, secondary folds and slits or cuts forming a series of panels that are arrange to be folded one on top of another in an accordion fashion. The panels are formed in adjacent sets of two with the width of each panel in a given set is the same and respective panel sets have widths that progressively decrease to expose a margin area on an outer edge of the panel set immediately therebelow. The margin area is sufficient in size to permit printed indicia. The book assembly has folded sections that can be selectively opened in several different directions.

5 Claims, 5 Drawing Sheets

FOLDOUT INFORMATION BOOK AND METHOD FOR MAKING THE SAME

BACKGROUND OF THE INVENTION

1. Field of the Invention

The present invention relates to information books, and more particularly information books having folded pages and margins that permit easy access to desired information about a particular topic. The present invention is particularly useful as a guide book for travelers featuring sites, maps and other information on particular cities.

2. Description of Related Art

When touring to various cities or countries around the world, travelers often use a variety of maps and books to locate various landmarks, sites and other features or items of interest, and to obtain information concerning maters such as local transportation, lodging, eating, telephones, customs, etc.. Frequently, all of the information a traveler may desire is not contained in a single, easily carried book. Thus, multiple books and maps are required, each for a different topic. In addition, it is often times difficult to match certain information on sites with locations on a map, as well as to find certain information of interest with ease.

For example, when trying to locate desired information for instance on a conventional folding map or compendium of maps and local information, there is no way to determine, before opening the map, on what part of the map the desired area is printed. Further, even if the particular area is known, it is usually necessary to unfold a large part, if not all, of the map in order to locate and view the desired area. Also, refolding a conventional folding map after it has been unfolded is notoriously difficult.

There are two common types of maps. The first type consists of a relatively large sheet of paper on which the map is printed. The sheet is folded into a convenient size for storage. This type of map is relatively inexpensive to produce, but has a distinct disadvantage in that the user must open the map out fully if he or she is to comprehend the meaning of any particular part of the map. Quite often this disadvantage is emphasized because the index is printed on the reverse side of the map. Consequently the map is inconvenient both when the map is used in a confined space such as in a car and also when it is used outside where wind would tend to make it impractical. Further, once the map has been used it must be folded and quite often the user finds it difficult to refold the map into its original folded condition. As a result the map is folded improperly. Soon the paper weakens, and the map begins to disintegrate.

A second type of map is in the form of a paperback pocket book. This type of map is more convenient than the first type, but is relatively more expensive to produce. It also suffers from the disadvantage that the convenient size of the book limits the page size and consequently the amount of information carried by each page. Metropolitan areas must be broken down into a large number of smaller areas so that quite often the user will find that the particular part of the map required lies partly on one page and partly on another in a different part of the book. This makes the book somewhat awkward to use and requires that the user relates the pages mentally.

It is also desirable that a map or guide book have an index, and that the index be in a form which is readily understood and remembered by the user so that items found in the index can then be found on the map. The first type of map discussed has a distinct advantage in this respect because generally the index refers only to two grid references. This contrasts with a book which generally requires firstly a page number, and then two grid references. Often a street will run through several pages so at a minimum the user of the book must remember three references in order to locate something found in the index on one page but may have to refer to several pages each requiring use of three references.

Several folding maps or information sources have been designed to overcome these drawbacks. One such map, shown for example in U.S. Pat. No. 4,210,347, is made up of a sheet which has a plurality of alternating accordion-like folds of decreasing width. The map is split into a north half and a south half, with each half having a plurality of panels which represent contiguous areas. The map further has a key and a color-matching system which allows for identification of the panel representing the desired area. However, the map described in U.S. Pat. No. 4,210,347 suffers from several disadvantages. Namely, a user often will not want to take the time to use the color-matching identification system, desiring instead a more direct way to identify what area is represented on a given panel. Further, by printed contiguous areas on adjacent panels, the map is restricted to extended representation in only one direction (i.e., east-west), and cannot represent an area extending in more than one direction (i.e., both east-west and north-south). Also, the printing of contiguous areas from panel to panel precludes the use of the exposed edge portions of each panel for printing information concerning the panels thereon.

One effort to overcome these problems is disclosed in U.S. Pat. No. 4,801,157. This map is made a single sheet which is folded in an alternating accordion-like fashion. A plurality of panels are defined between the folds, each panel having a map portion and an information-bearing portion. The panels are of decreasing width so that the information bearing portion of each panel are visible when the map is completely folded. The map can further include a key printed on the front panel, and a color-matching system and/or a mark system which facilitate location of a desired area on the map. However, this map booklet uses an accordion fold system that allows pages to be turned in only one direction. Such a fold decreases the amount of information space available. If additional information about a particular area were to be included, the booklet described in this patent would become large and cumbersome.

A similar map is illustrated in U.S. Pat. No. 4,348,038. This booklet contains an accordion folded sheet that allows margins on pages to be visible without fully opening the map. In addition, other information on various sites and attractions are also indexed and visible to the user. However, like U.S. Pat. No. 4,801,157, the pages fold out in only one direction. Information contained in the book is, therefore, limited.

The present invention is intended to provide an improved information source having the advantages of a book while at the same time providing a simple index system, and pages which are folded such as in a map, to provide a larger format than that normally found in a book. The folded pages are arranged so they cannot be readily damaged by incorrect folding and yet the pages can be inter-related imperfectly without damage and without affecting the index arrangement.

SUMMARY OF THE INVENTION

It is therefore an object of the present invention to overcome the deficiencies associated with the prior known types of maps and guide books by providing an information book having a dual folded pages formed out of a single sheet. The information book according to the present invention contemplates a plurality of primary accordion-like alternating folds of decreasing spacing which define a plurality of panels of decreasing width therebetween, each of the panels comprising markings thereon representative of a given area. In addition, because of their decreasing width, when the panels are folded, an information-bearing margin is provided at the edge area of each panel containing indicia concerning various informational aspects of the particular geographical area or other information represented in the book. This indicia is printed along an edge of the panel of an adjacent fold, the information-bearing portions together forming a visible index.

Because of the decreasing width of each panel, the information-bearing portion of each panel is visible when the sheet is folded. Therefore, the user can easily identify and refer to the panel which contains the information desired concerning the area of interest. Further because of the accordion-like folds, only a single pair of adjacent panels need be unfolded or flipped open. Thus, there is no complicated unfolding and refolding process. Also, the map can be opened to the desired area using only one hand.

In addition, at least one secondary fold is provided approximately perpendicular to the primary fold, and a cut is made along sides of adjacent pairs of primary folded panels, thereby producing additional panels that can be unfolded perpendicularly to the primary panels. This arrangement allows for additional information to be provided on a given page, that is, by opening a particular pair of adjacent primary panels. Also, maps and other information can be matched allowing the user to obtain desired information using a single source. The resulting information book can be made of any size, but is particularly useful; when made as a small, pocket-sized book.

To obtain these and other advantages, one aspect of the present is a book assembly made of at least one generally planar sheet having an upper side and a reverse side with writing thereon. The sheet is provided with a plurality of primary folds forming a series of panels that are arrange to be folded one on top of another in an accordion fashion. The panels are formed in adjacent sets of two with a primary fold therebetween. The width of each respective panel progressively decreases to expose a margin area on an outer edge of the panel set immediately therebelow. The margin area is sufficient in size to permit printed indicia.

In addition, the present invention is also provided with a series of secondary folds and slits are formed along side edges of selected panel sets. The secondary slits and folds are generally perpendicular to the primary folds such that each selected panel set further defines two additional panels, and that permit the additional panels to be unfolded upwardly or downwardly (or both) perpendicularly to the primary folds.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof which makes reference to the annexed drawings wherein.

DESCRIPTION OF THE PREFERRED EMBODIMENTS

Figure 1:
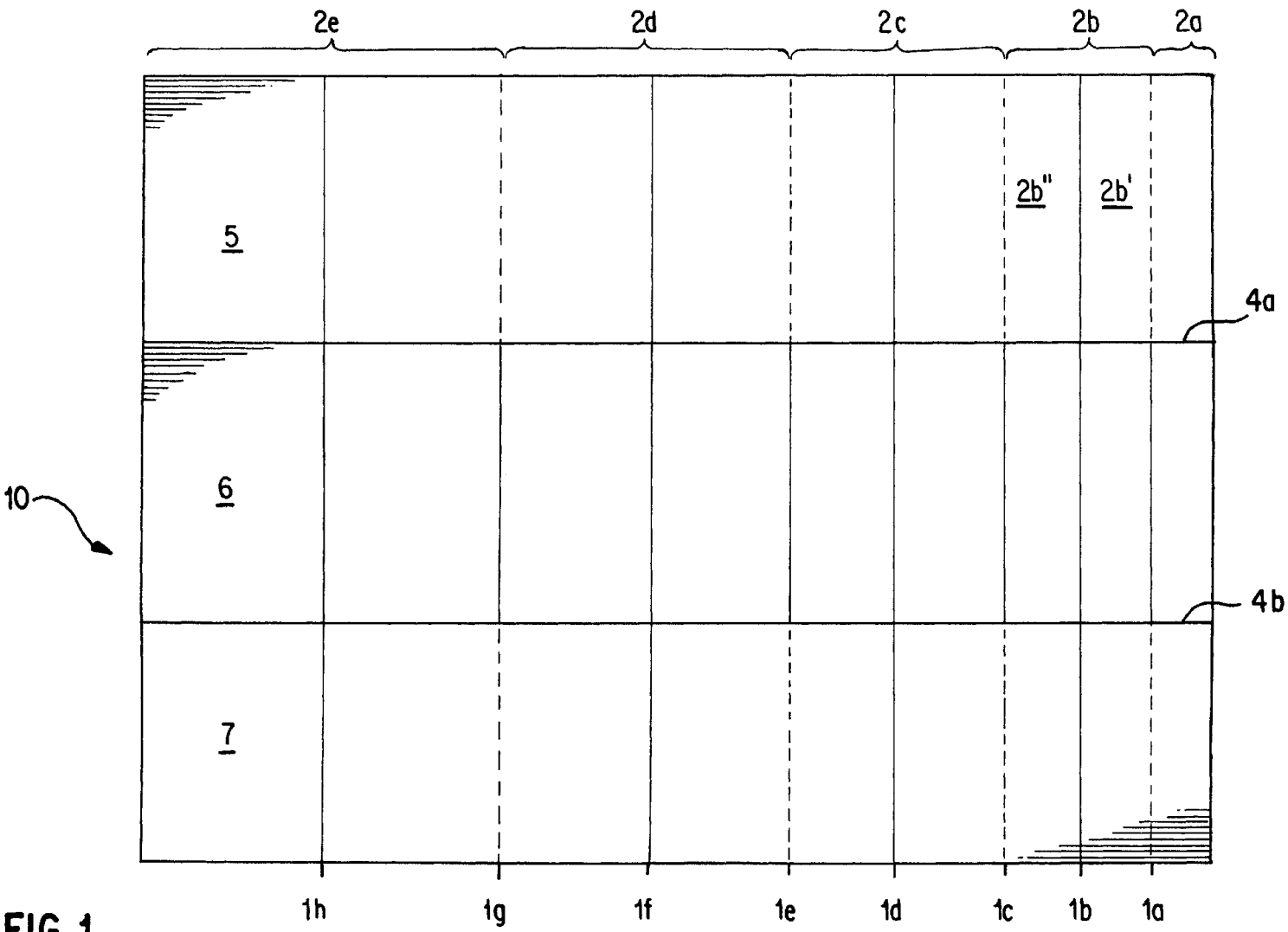
FIG. 1 is a plan view of the planar sheet showing the primary and secondary folds in solid lines and slits shown in broken lines.

The following is a brief description of the basic embodiments of the present invention. As illustrated in FIG. 1, sheet 10 is generally rectangular, and includes a plurality of folds running generally parallel to each other, perpendicular to the long side of sheet 10. In the illustrated embodiment, eight primary folds, 1*a*–1*h* are formed in the along the short side of sheet 10. Primary folds 1*a*–1*h* form a series of primary panel sets 2*a*–2*e* (2*a* having a single panel in the illustrated embodiment). Five primary panel sets are illustrated here, however, the number of sets can be selected at any number, provided the number allows the accordion-type primary fold to occur.

Figure 2:
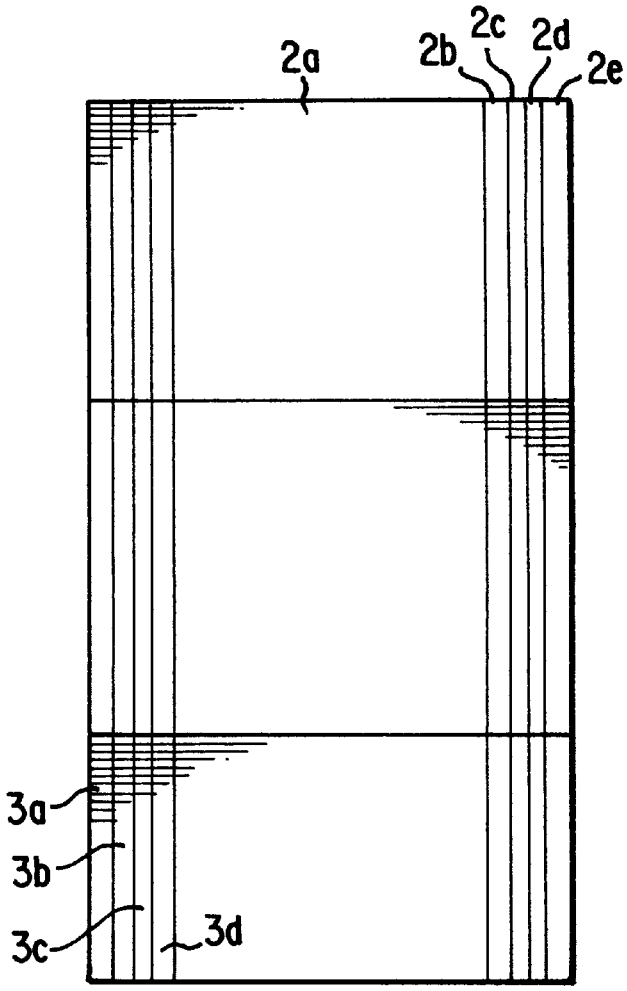
FIG. 2 is a top view of the panels shown in a folded arrangement.

As seen in FIG. 1, the primary panel sets starting at 2*b* are formed of two adjacent panels, e.g., 2*b*' and 2*b*". Viewing FIG. 1 from panel 2*a* toward panel 2*e,* the panels increase in width. Primary folds 1*a*–1*h* are folded in an accordion fashion such that panel 2*a* will sit on top of panel 2*b* which is folded along primary fold 1*b,* and so on. When folded along primary folds 1*a*–1*h,* because of the increasing size of panel width, margin areas 3*a*–3*d* are formed as seen in FIG. 2. These margin areas are designated space for indexing information concerning the material printed on a particular panel.

Returning to FIG. 1, also illustrated are a series of slits or partial cuts along selected primary folds 1*a*–1*h*. In FIG. 1, the slits or cuts are shown on dotted lines along portions of primary folds 1*a,* 1*c,* 1*e* and 1*g*. The number of slits or cuts depends on the number of panels to be formed. As illustrated, the slits or cuts are provided along every other primary fold, thereby defining an upper and lower panel part for each primary panel.

In addition, two additional or secondary folds 4*a* and 4*b* are provided. Secondary folds 4*a* and 4*b* are generally parallel to one another and perpendicular to the primary folds. FIG. 3 illustrates sheet 10 when folded first along the secondary folds and then along the primary folds. Due to the placement of primary folds, slits or cuts, and secondary folds, each panel part of a panel set is divided into three parts 5, 6 and 7. Lower panel part 7 is folded along secondary fold 4*b* such that in a closed position, it overlays middle panel part 6. Upper panel part 5 is folded along secondary fold 4*a* such that when it is closed it overlays lower panel part 7 and middle panel part 8.

Figure 4:
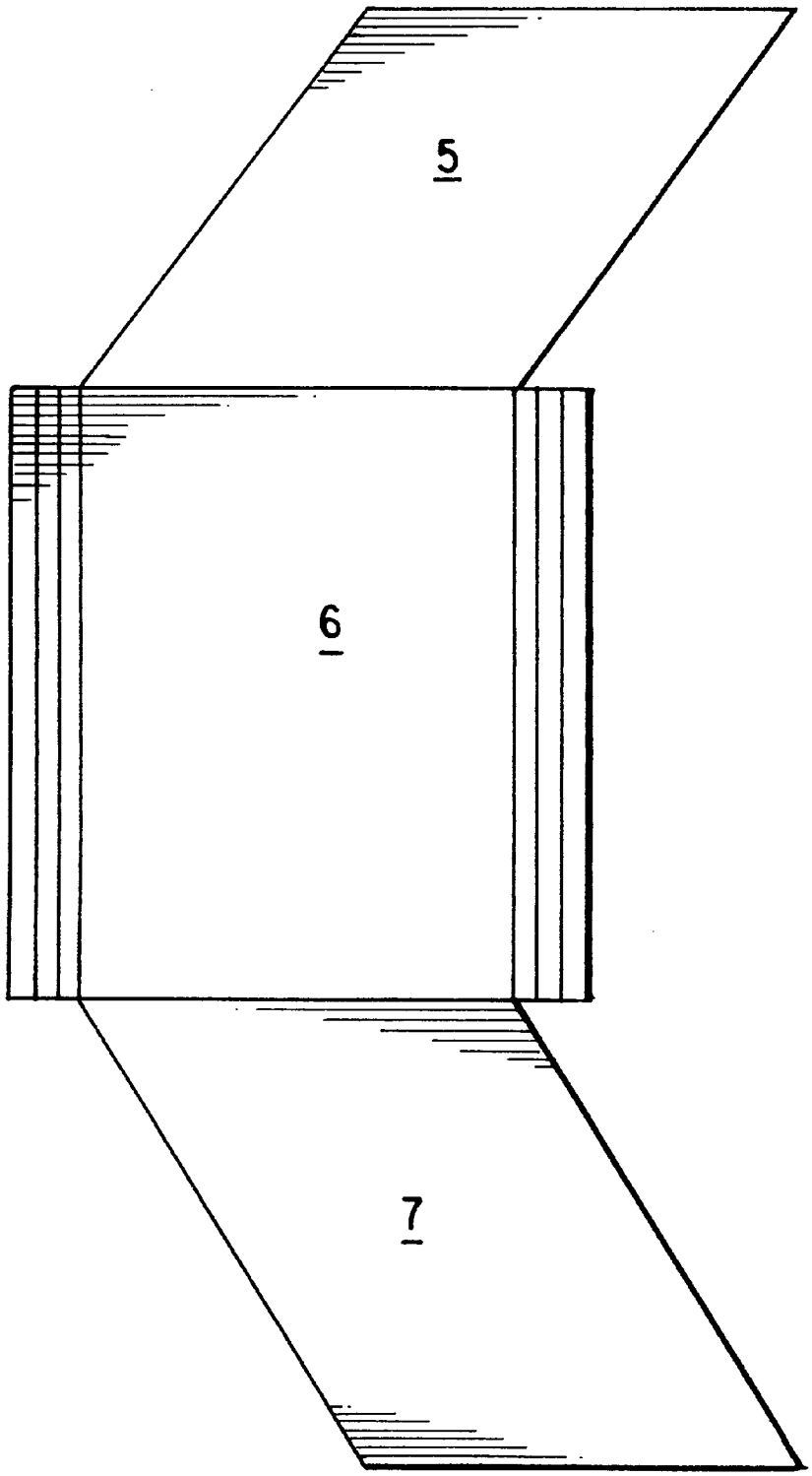
FIG. 4 is a perspective view of the book having been partially opened along a secondary fold.

As shown in FIG. 4, when opening the pages, upper and lower panel parts 5 and 7 are turned upwardly and downwardly, respectively, perpendicularly to secondary folds 4*a* and 4*b*. Accordingly, each panel forms a page with six surfaces for information to be recorded, the front and back sides of panels 5, 6 and 7 respectively.

Figure 5:
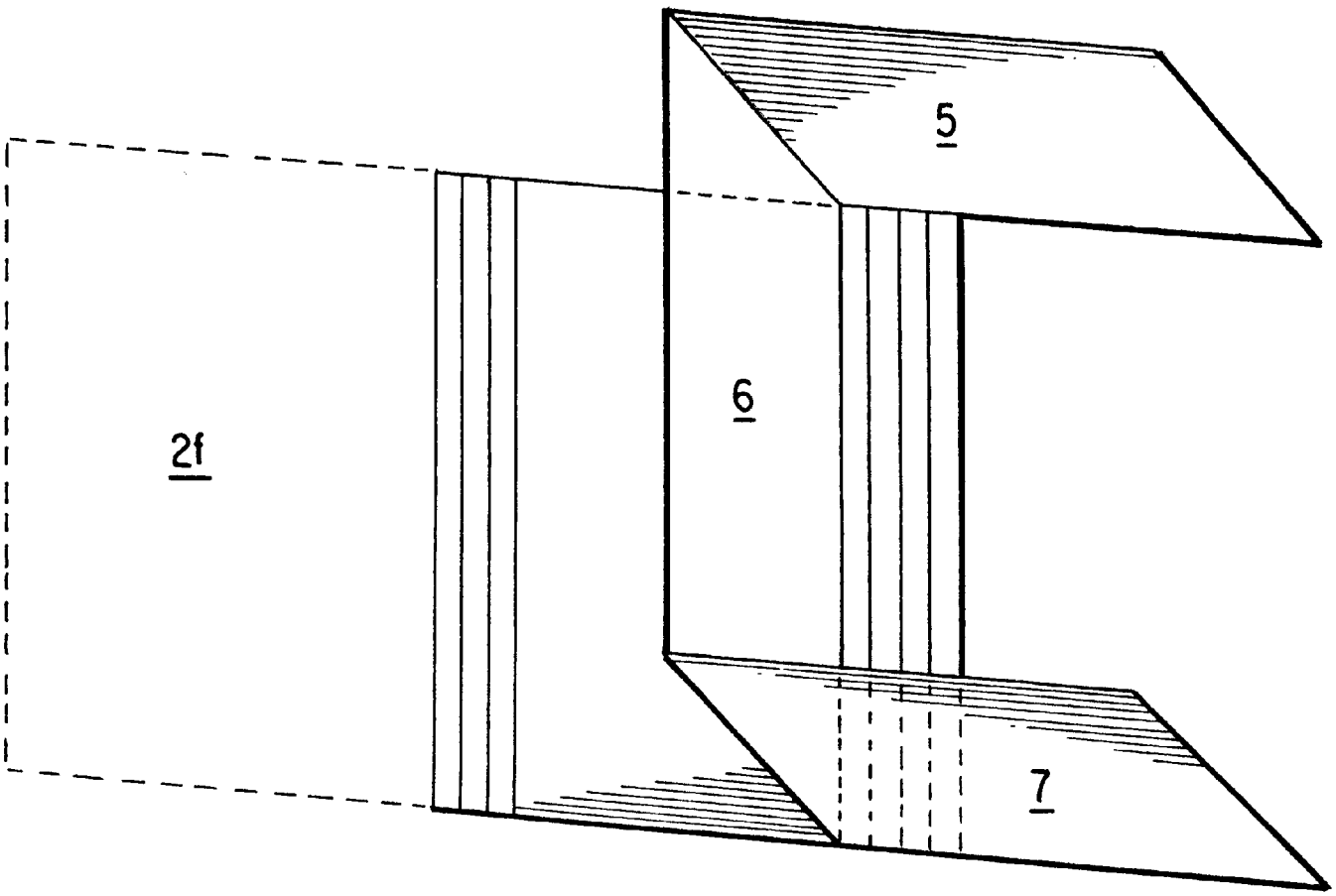
FIG. 5 is a perspective view of the book having been partially opened along a primary and secondary fold.

As shown FIG. 5, the information book according to the present invention has a plurality of panels that can be opened from two or more directions. Because of the placement of the slits or cuts, each panel set can be turned in a page fashion from right to left or left to right. In this particular embodiment, when the panel 2*a* is turned from the right edge toward the left, panel set 2*b* will be exposed (See FIGS. 1–3). From this position, the upper panel and lower panel of panel set 2*b* can be opened. If panel 2*a* is turned from the left edge toward the right, the back side of panel set 2*b* is opened. In this arrangement, the upper and lower panel parts of panel 2*b* cannot be opened.

Figure 3C:
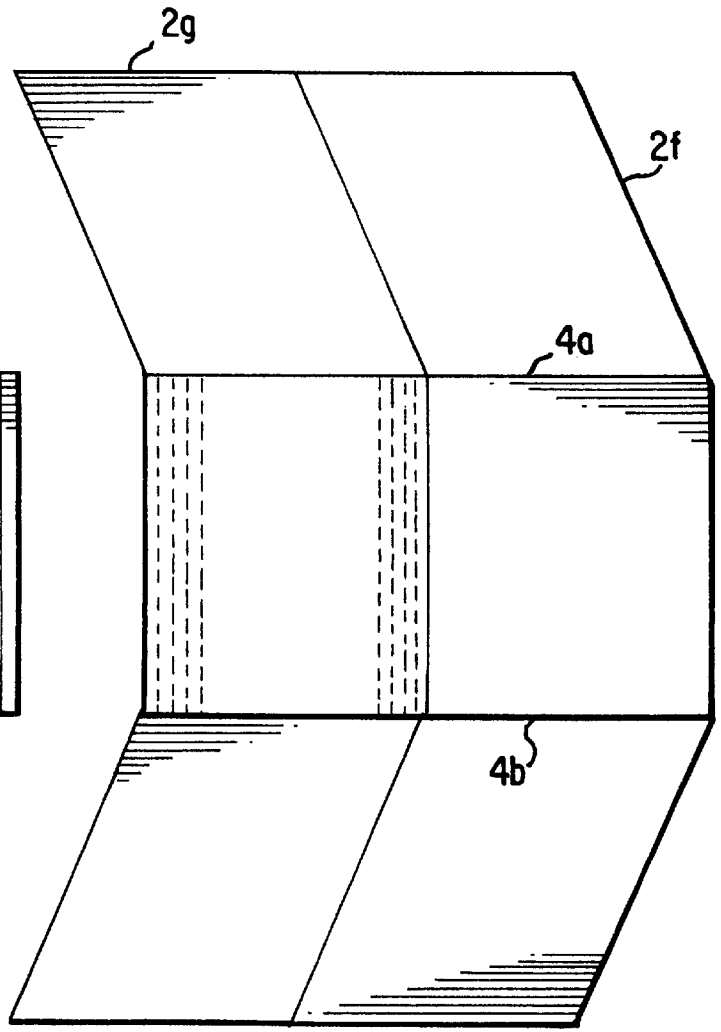
FIGS. 3*a–c* are top views of panels in a folded arrangement with a cover and back.
Figure 3B:
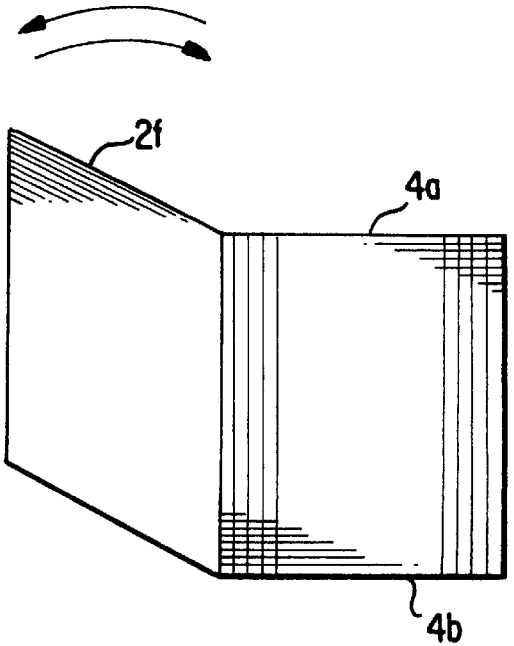
Figure 3A:
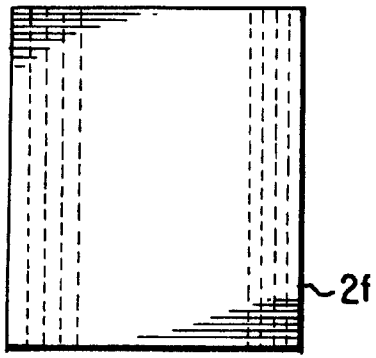

In addition, a cover and back page can also be formed by adding an additional panel sections 2*f* and 2*g*, respectively, as shown in FIGS. 3*a–c*. The cover section 2*f* is formed by an additional set of primary and secondary folds, and can be opened and closed as illustrated by the arrows in FIG. 3*b*. In addition, because of the primary and secondary folds, when the information book is turned over, as illustrated in FIG. 3*c*, additional panel segments can be unfolded and additional information can be provided. Because of the decreasing width arrangement of panels, indexing or cataloging indicia may be printed on the margin areas 3*a*–3*d*. This allows the user to easily open to the desired page to obtain specific information. Because of the increasing size of each panel, several different types of information can be provided in one easy and convenient book, such as street maps, dictionaries, sites, restaurant guides, etc.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A book assembly comprising:

at least one sheet having an upper side and a back side, the sheet having a plurality of substantially parallel primary folds therein forming a series of panels that are arrange to be folded one on top of another in an accordion fashion, the panels being formed in adjacent sets of two with successive panels having widths that progressively decrease to expose a margin area on an outer edge of the panel set in the folded state of the sheet on which printed indicia may be placed; wherein at least one secondary fold is formed in the sheet, substantially perpendicular to the primary folds; and a series of slits are formed along side edges of selected panel sets such that each selected panel set further comprises at least two additional panels formed by the secondary fold that permits the at least two additional panels to be unfolded upwardly or downwardly perpendicularly to the primary folds.

2. The book assembly according to claim 1 wherein the slits are formed along upper and lower portions of the plurality of primary folds thereby forming three panel parts having five surfaces for printed indicia for each panel set.

3. The book assembly according to claim 2 wherein one of the panel sets forms a front and rear cover of the book.

4. A book assembly comprising:

a sheet of material having an upper side and a back side;

a plurality of substantially parallel primary folds formed in the sheet, forming a series of panels that are arranged to be folded one on top of another in accordion fashion, with successive panels having progressively decreasing widths such that with the panels folded on top of one another, a margin area on an outer edge of each panel is exposed to form an area on which printed information can be placed;

at least one secondary fold along an axis substantially perpendicular to the primary folds, the secondary fold dividing each panel into at least first part and second portions; and a plurality of slits formed in the at least first portions along the primary folds between selected pairs of adjacent panels, the slits extending from an edge of the sheet to the secondary folds, such that the first portions of a selected pair of panels can be selectively unfolded to expose additional surfaces of the sheet.

5. A method for folding a sheet into a book assembly comprising::

folding a plurality of substantially parallel primary folds in the at least one sheet;

forming a series of panels that are arrange to be folded one on top of another in an accordion fashion, the panels being formed in adjacent sets of two with successive panels having widths that progressively decrease to expose a margin area on an outer edge of the panel set in the folded state of the sheet;

folding at least one secondary fold in the sheet, substantially perpendicular to the primary folds; and slitting selected panel set side edges such that each selected panel set forms at least two additional panels having folded edges at the secondary fold thereby permitting the at least two additional panels to be unfolded upwardly or downwardly perpendicularly to the primary folds.

* * * * *